US006215232B1

(12) United States Patent
Johnson et al.

(10) Patent No.: US 6,215,232 B1
(45) Date of Patent: Apr. 10, 2001

(54) MICROCHANNEL PLATE HAVING LOW ION FEEDBACK, METHOD OF ITS MANUFACTURE, AND DEVICES USING SUCH A MICROCHANNEL PLATE

(75) Inventors: Charles Bruce Johnson; Robert L. Pierle, both of Phoenix, AZ (US); Po-Ping Lin, Palo Atlo, CA (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/444,945

(22) Filed: Nov. 22, 1999

Related U.S. Application Data

(63) Continuation of application No. 08/611,003, filed on Mar. 5, 1996, now abandoned.

(51) Int. Cl.[7] ..... H01J 43/00
(52) U.S. Cl. ..... 313/103 CM; 313/105 CM
(58) Field of Search ..... 313/103 CM, 105 CM, 313/103 R, 105 R, 373, 379; 250/207

(56) References Cited

U.S. PATENT DOCUMENTS

| | | | |
|---|---|---|---|
| 3,564,323 | | 2/1971 | Maeda . |
| 3,674,712 | | 7/1972 | Orthuber . |
| 3,742,224 | | 6/1973 | Einstein . |
| 3,974,411 | | 8/1976 | Faulkner et al. . |
| 4,051,403 | | 9/1977 | Feingold et al. . |
| 4,568,853 | * | 2/1986 | Boutot ..... 313/103 CM |
| 4,608,519 | * | 8/1986 | Tosswill ..... 313/103 CM X |
| 4,737,013 | | 4/1988 | Wilcox . |
| 5,130,527 | | 7/1992 | Gramer et al. . |
| 5,132,586 | | 7/1992 | Boulais et al. . |
| 5,159,231 | | 10/1992 | Feller et al. . |
| 5,493,169 | | 2/1996 | Pierle et al. . |
| 5,565,729 | * | 10/1996 | Faris et al. ..... 313/103 CM |

OTHER PUBLICATIONS

Article Entitled "Preliminary Results with Saturable Microchannel Array Plates," J. g. Timothy, Rev. Sci. Instrum., vol. 45, No. 6, Jun. 1974.

Article Entitled "Microchannel Plates in Low–Light–Level High–Speed Imaging Systems," Christopher H. Tosswill, The International Society for Optical Engineering, pp. 125–129; Dec. 1983.

* cited by examiner

*Primary Examiner*—Ashok Patel
(74) *Attorney, Agent, or Firm*—Marsteller & Associates, P.C.

(57) ABSTRACT

Microchannel plates are provided having an array of multiple channel electron multipliers for use in night vision devices, image intensifier tubes, photomultiplier tubes, and other such devices with improved gain, higher signal-to-noise ratio, and better resolution. The microchannel plates disclosed herein utilize a bulk-conductivity substrate material, and provide features for improving secondary electron-emissivity of the material.

5 Claims, 6 Drawing Sheets

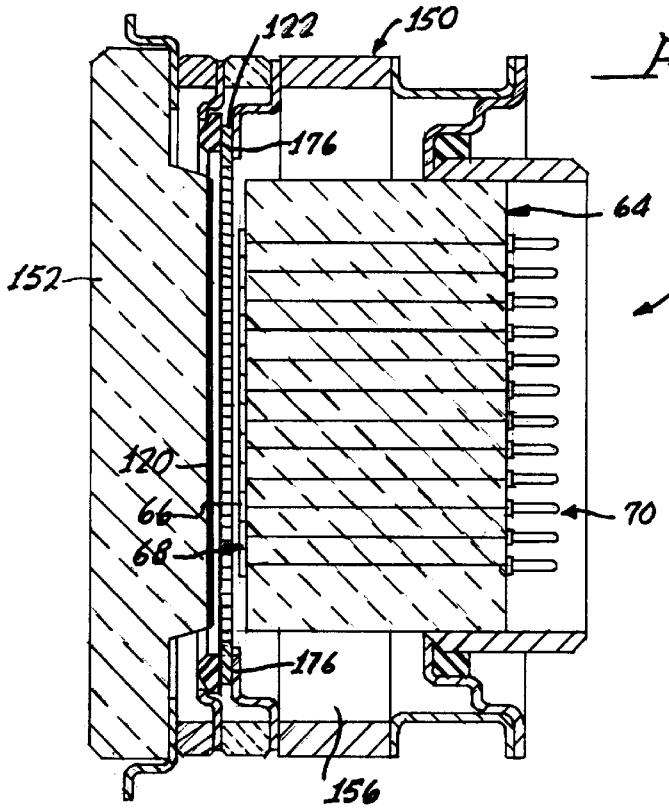
FIG. 3.
FIG. 4a.
(PRIOR ART)
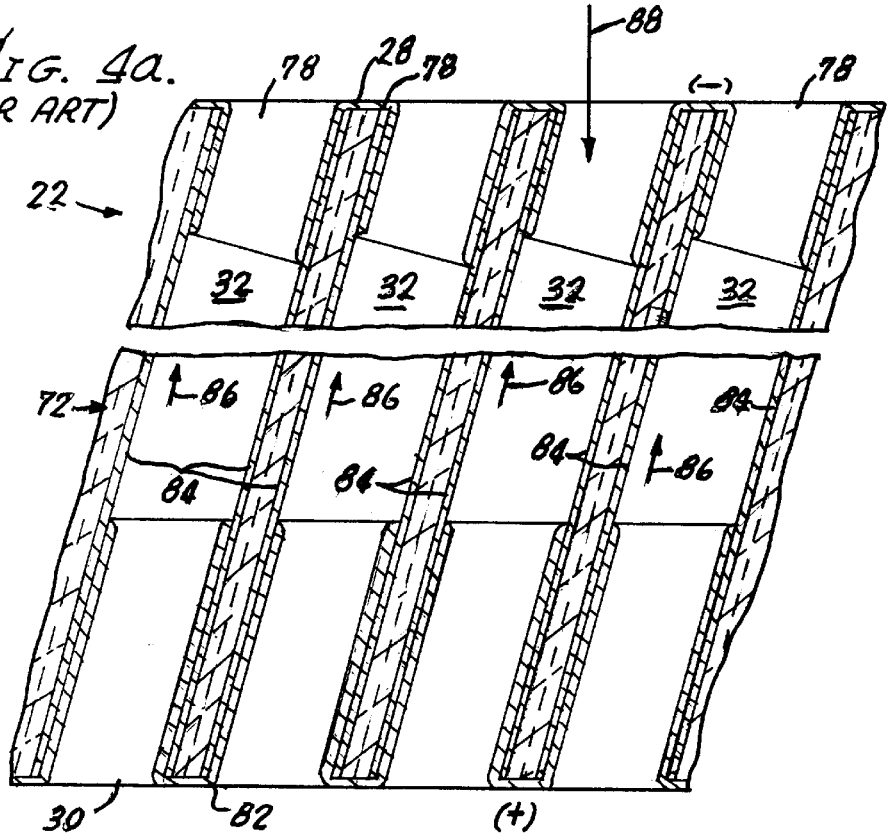

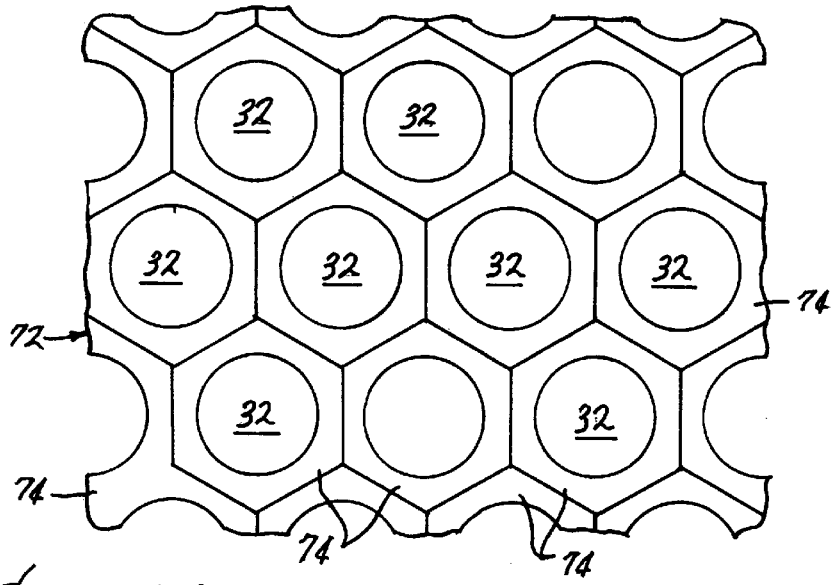
FIG. 4b.
(PRIOR ART)
FIG. 5.
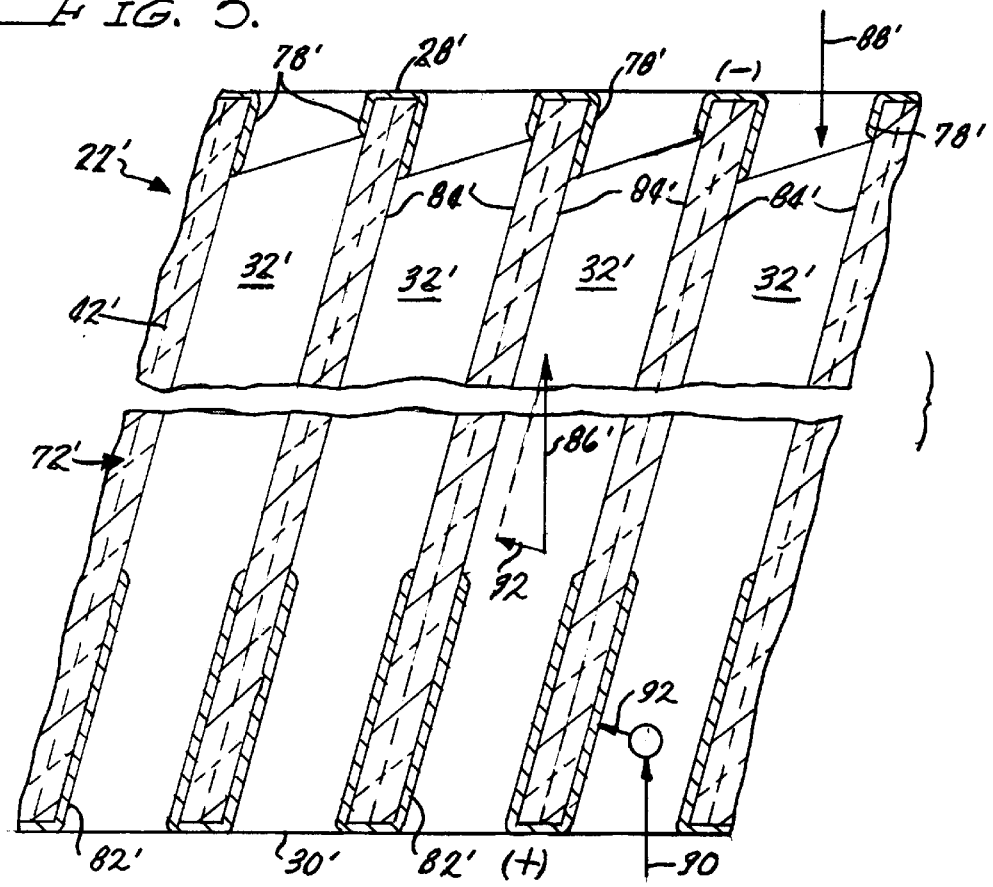

FIG. 6.
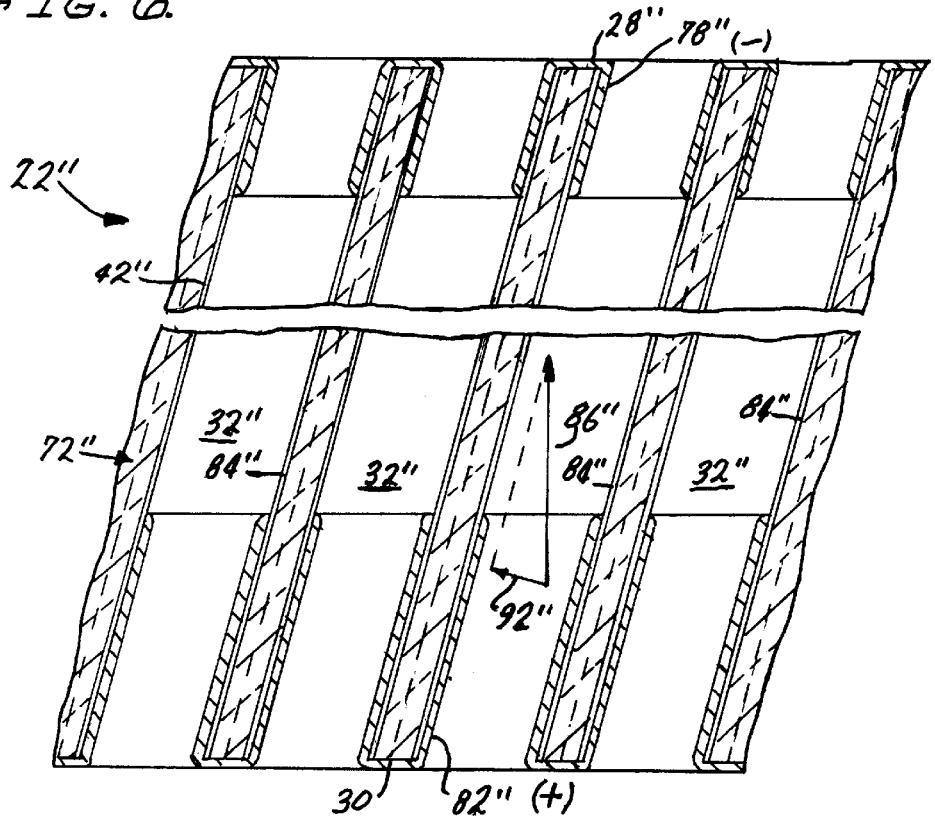
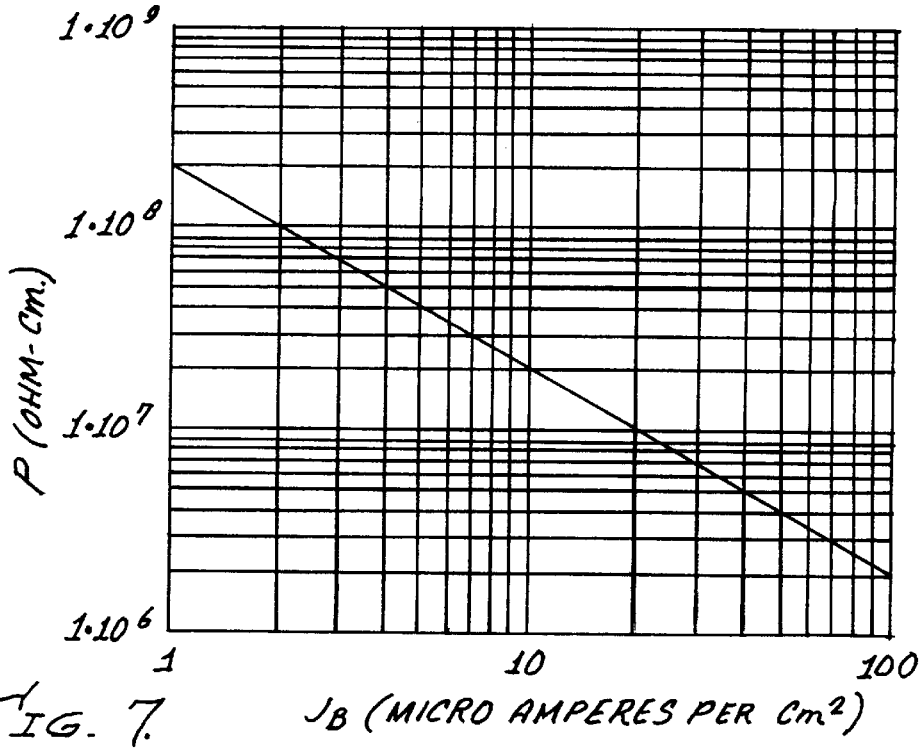
FIG. 7.

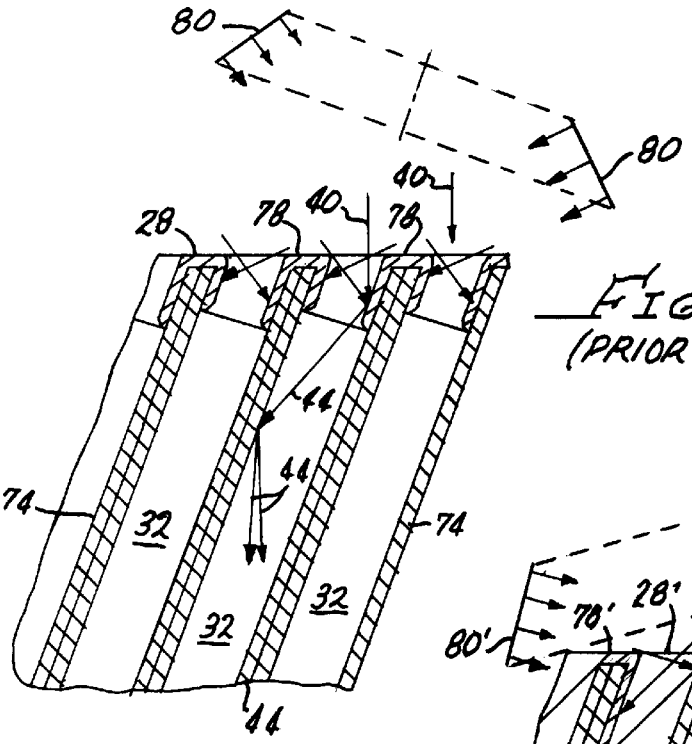
FIG. 8.
(PRIOR ART)
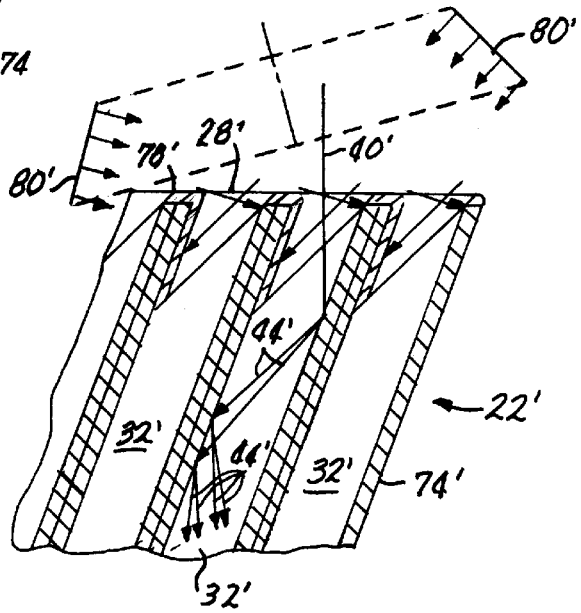
FIG. 9.
(PRIOR ART)
FIG. 11.
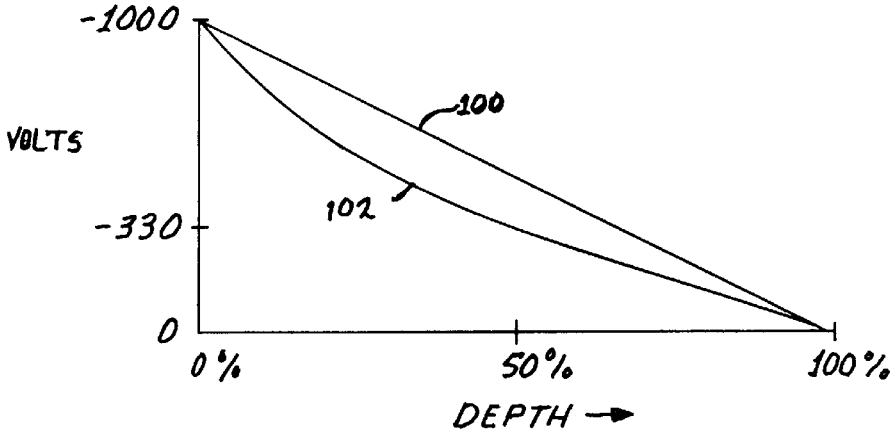

MICROCHANNEL PLATE HAVING LOW ION FEEDBACK, METHOD OF ITS MANUFACTURE, AND DEVICES USING SUCH A MICROCHANNEL PLATE

This appln is a con't of U.S. Ser. No. 08/611,003 filed Mar. 5, 1996, Abnd.

FIELD OF THE INVENTION

The present invention relates in general to an improved microchannel plate and method for its manufacture. More particularly, the present invention relates to a microchannel plate which provides for low positive ion flow through the microchannel plate. This microchannel plate provides for increased gain, reduced noise, and improved signal-to-noise ratio. Still more particularly, the present invention relates to devices, such as an image intensifier tube or photomultiplier tube, which includes a photocathode sensitive to ion feedback and which uses a microchannel plate according to the present invention to reduce ion feedback and impact on the photocathode.

BACKGROUND OF THE INVENTION

The channel electron multiplier (CEM) is a well known device. The CEM consists of an elongate tube of material which is a secondary emitter of electrons. Conventionally, this secondary electron emitter material is carried on the inner surface of a structural tube formed of insulative material. An electric current, and associated electrostatic field in the secondary electron emitter material, is maintained along the length of the CEM from an inlet end to an outlet end of the tubular CEM structure. Because the performance of the conventional CEM depends on length-to-diameter ratio rather than physical size of the structure, the channel size can be reduced to very small dimensions.

Accordingly, arrays of plural channel electron multipliers have been fabricated. A conventional device which provides such an array of channel electron multipliers is the microchannel plate. Conventionally, microchannel plates are made by drawing a number of fine-dimension glass tubes of either a hollow configuration or of a configuration with a removable core fiber. The glass tubes are joined in bundles and further drawn under pressure causing the tubes to bond to one another at their outer surface, thus forming a boule or elongate rod-like structure of multiple fine-dimension glass tubes in parallel. Next, a pair of spaced apart parallel transverse cuts across this boule of glass tubes defines between the cut lines a comparatively thin plate having perhaps a million glass tubes extending between its opposite faces. If the glass tubes are of fiber core construction, the core fiber is etched out using chemicals. For example, an acid or a base may be used to etch the glass.

The inner surface of each of the multitude of glass tubes (or microchannels) is then activated to make this glass surface a practical secondary emitter of electrons. This activation of the glass surface is effected by reducing this surface at elevated temperature in a hydrogen atmosphere. The glass of the tubes is made of a material which is doped with selected materials, such as lead and antimony. After reduction of the glass, this doped glass leaves metal atoms or metal oxide molecules exposed on and close to the inner surface of the microchannels, and provides a thin coating of glass semiconductor material extending along the inner surface of the microchannels between the opposite faces of the plate.

A metallic electrode is applied to each of the opposite faces of the plate, and the microchannel plate is operated with an applied electrostatic potential applied across these electrodes. As a result, a current flow between the electrodes takes place in the surface layer of reduced semiconductor glass, which current is referred to as the "strip current" of the microchannel plate. Because the glass of the tubes is itself an insulator with a bulk-resistivity in the range of $10^{17}$ to $10^{22}$ ohm-cm, substantially no practical electric current flows in the body of the microchannel plate itself—other than in the semiconductor reduced-glass coating each of the microchannels. The microchannel is operated in an evacuated environment of reduced pressure to allow electron flow along the channels with amplification by secondary emission of electrons from the inner surfaces of the microchannels.

The microchannels in a conventional microchannel plate are straight, and hence are subject to ion feedback. The ion feedback occurs because molecules and atoms of residual gas and other materials in the operating environment of the microchannel plate, and which become positively charged, are accelerated by the applied electrostatic field in a direction opposite to the electron flow. Because these ions are both very massive compared to an electron, and are accelerated to a high potential energy by the applied electrostatic field, they can be destructive to surfaces which they impact, and the impacting ions can cause unwanted emissions of electrons from the microchannel walls and/or the photocathode. As is known in the technologies using microchannel plates, these ions flowing toward a photocathode, for example, can both erode the photocathode by their dynamic impact, and also may imbed into the cathode, thus changing the crystalline structure and chemistry with resulting loss of performance of the photocathode to liberate photoelectrons in response to incident photons of radiation.

For these reasons, conventional microchannel plates have been operated in pairs with the microchannels of the paired plates forming a chevron shape to trap ions feeding back toward the inlet end of the first microchannel plate. Unfortunately, it is impossible to precisely align the microchannels of one plate to those of the other, so that resolution of paired microchannel plates is always less than one plate alone could provide. Alternatively, a few microchannel plates have been formed with curved channels in order to impact the ions with the walls of the channels, and thereby recombine the ions with an electron to produce neutral particles. However, microchannel plates with curved channels are very expensive and difficult to manufacture.

Conventional devices which use microchannel plates are image intensifier tubes of night vision systems, and photomultiplier tubes. Photomultiplier tubes are used for such purposes as scintillation detectors in particle accelerators and fluoroscopic detectors of chemical analyzers. A night vision system converts available low intensity ambient light to a visible image. Such night vision systems require some residual light, such as moon or star light, in which to operate. The star-lighted sky of the night is generally rich in infrared radiation, which is invisible to the human eye. The infrared ambient light is intensified by the night vision scope to produce an output image in light which is visible to the human eye. The present generation of night vision scopes use image intensification technology with a photocathode responsive to both visible and infrared photons to release photoelectrons. One or more microchannel plates are used to amplify the low level of photoelectrons to render a shower of secondary-emission electrons in a pattern replicating the invisible infrared image. These electrons are directed onto a phosphorescent screen to provide a visible image.

Alternatively, a microchannel plate can be used as a "gain block" in a device having a free-space flow of electrons.

That is, the microchannel plate provides a spatial output pattern of electrons which replicates an input pattern, and at a considerably higher electron density than the input pattern. Such a device is useful as a particle counter to detect high energy particle interactions which produce electrons.

Regardless of the data output format selected, the sensitivity of the image intensifier or other device utilizing a microchannel plate is directly related to the amount of electron amplification or "gain" imparted by the microchannel plate. That is, as each photoelectron enters a microchannel and strikes the wall, secondary electrons are knocked off or are emitted from the area where the photoelectron initially impacted. The physical properties of the walls of the microchannel are such that, generally and statistically speaking, a plurality electrons are emitted each time these walls are contacted by one energetic electron. In other words, the material of the walls has a high coefficient of secondary electron emissivity or, put yet another way, the electron-emissivity of the walls is greater than one.

Propelled by the electrostatic field across the microchannel plate, the secondary-emission electrons travel along the microchannels toward the far surface of the microchannel plate and away from the photocathode and point of entry of the photoelectrons. Along the way, each of the secondary-emission electrons repeatedly impacts with and interacts with the walls of the microchannel plate resulting in the emission of yet more secondary-emission electrons. Statistically, some of the photoelectrons and secondary-emission electrons are absorbed into the reduced glass semiconductor material at the inner surface of the microchannels so that generally not all of the secondary-emission electrons escape the plate at the exit end of the microchannels. However, the secondary electrons continue to increase or cascade along the length of the microchannels.

The number of electrons emitted thus increases geometrically along the length of the microchannel to provide a cascade of electrons arising from each one of the original photoelectrons which entered the microchannel. As discussed above, this electron cascade, in a pattern which replicates the initial pattern of photoelectrons, then exits the individual channels of the microchannel plate and, under the influence of another electrostatic field, is accelerated toward a corresponding location on a display electrode or phosphor screen. The number of electrons emitted from a microchannel, when averaged with those emitted from the other microchannels, is equivalent to the theoretical amplification or gain of the microchannel plate.

While the intensity of the original image may be amplified several times, various factors can interfere with the efficiency of the process thereby lowering the sensitivity of the device. For example, one inherent problem of microchannel plates is that a photoelectron released from the photocathode may not fall into one of the slightly angulated microchannels, but may impact the bluff conductive face of the plate in a region between the openings of the microchannels. Electrons that hit the conductive face are likely to produce low energy secondary electrons or high energy reflected electrons which move back toward the photocathode for a distance before being returned by the applied electrostatic field to the microchannel plate and into a microchannel. Such photoelectrons then produce in a microchannel spaced from their initial point of impact a number of secondary electrons. These secondary electrons are issued from a part of the microchannel plate not aligned with the proper location of photocathode generation, and decrease the signal-to-noise ratio as well as visually impairing the image produced by an image intensifier tube. Other times the errant electron is simply absorbed by the conductive face of the plate and is not amplified to produce part of the image or signal produced by the detector anode. Such an electron loss reduces the effective gain and signal-to-noise ratio of a microchannel plate.

Of course, one solution to this problem is to increase the amount of microchannel aperture area and reduce the amount of bluff surface area on the input face of the microchannel plate as was done in U.S. Pat. No. 4,737,013, issued Apr. 12, 1988, to Richard E. Wilcox. Through the use of an etching barrier around each microchannel these particular microchannel plates have an improved ratio of total end open area of the microchannels to the active area of the plate (i.e., an improved open area ratio, "OAR", at the inlet ends of the microchannels). Specifically, the etching barrier incorporated in the plate allows more precise etching of the microchannel tubes in the plate. The technique allows the plates to be produced with a theoretical open area ratio (OAR) of up to 90% of the plate active surface. As a result, the photoelectrons are not as likely to miss one of the microchannels and impact on the face of the microchannel plate to be bounced into another one of the microchannels. This higher OAR improves the signal-to-noise ratio of image intensification.

While the OAR may be improved using conventional methods, other factors still reduce the gain and decrease the signal-to-noise ratio of the conventional microchannel plate. In particular, coating the input face of the conventional microchannel plates with a conductive metallic electrode material significantly reduces the gain provided by a microchannel plate. Generally, the conductive metallic electrode materials on a statistical basis have an electron-emissivity coefficient of less than unity (i.e., less than one). More particularly, conventional deposition procedures for these metallic electrodes entail rotationally disposing the microchannel plate so that the axis about which the microchannel plate is rotated parallel the axis of the microchannels. A deposition source for the metallic electrode is thus angularly disposed relative to the axis of the microchannels at a distance for the input face of the plate. As the microchannel plate is rotated, metallic material is evaporated from the source onto the microchannel plate.

Because the microchannel plate rotates about an axis which is parallel with the axis of the microchannels, the metallic material from the source coats not only onto the input face of the microchannel plate, but also for a distance into the microchannels themselves. The distance into the microchannels to which the metallic electrode material will coat is dependent upon the angulation of the source with respect to the axis of the microchannels themselves in essentially a line-of-sight process. Because the microchannel plate is rotated about an axis parallel to the axis of the microchannels, the depth of metallic coating penetration into the microchannels is substantially uniform circumferentially about the microchannels.

As a result, in addition to covering the face of the microchannel plate, the conductive electrode coating extends into the individual microchannels of the plate, covering a substantial portion of the entrance surface portion of each microchannel which would be visible (on a microscopic scale) if one were to look into the microchannels perpendicularly to the face of the plate. Accordingly, while conventional processes and methods for deposition of the metallic conductive electrode material renders the parallel faces of the microchannel plates sufficiently conductive, the unavoidable coating of at least a part of the inner entrance surface portion of the microchannels themselves unavoidably interferes with amplification of photoelectrons due to the low electron-emissivity coefficient of the metallic coating material.

However, the solution to this problem of lost gain is not as simple as simply increasing the length of the microchannels so as to extend the length over which the secondary electron emission process is effective. Initially, it would seem that the gain of a microchannel plate could be increased indefinitely simply by making the plate thicker. However, a microchannel plate cannot simply be made thicker because doing so severely and adversely affects the signal-to-noise ratio of the microchannel plate. The reason for this prohibition against increasing the thickness of a microchannel plate to increase its gain can be understood when one considers the statistical effects involved in emission of secondary electrons within the microchannels.

Each time an electron impacts the wall of a microchannel, there is a probability of the electron causing the emission of one or more secondary electrons. For the metallic electrode material, which is on the entrance portions of the microchannels of conventional microchannel plates, this probability coefficient is about unity (i.e., 1). Thus, there is some electron signal loss and loss of amplification length for the microchannel plate because of this metallic electrode material at the entrance portion of the microchannels. For the material along substantially the remaining length of the microchannels, the secondary electron-emissivity is greater than one, and the statistical process results in an increase in the number of electrons moving along the channels from the entrance end to outlet end. However, each time an electron impacts the walls of a microchannel, there is also the statistical probability that a positive ion will be released. When a positive ion is released, it travels in the opposite direction to the electron flow along the microchannel because of the prevailing electrostatic field. As a positive ion travels toward the entrance end of a microchannel, it also will impact and interact with the walls of the channel. Similarly to an electron, a positive ion has a probability of causing emission of secondary electrons.

Secondary electrons which are emitted because of positive ions moving toward the inlet end of a microchannel plate and impacting the channel walls represent noise in the output of the microchannel plate. A point of diminishing returns is reached if a microchannel plate is increased in thickness beyond a certain length-to-diameter ratio for the microchannels. Further increase in the thickness of the microchannel plate results in little or no increase in gain because of space-charge saturation. If the voltage across the microchannel plate is increased to overcome the space-charge saturation limit, the probability of emission of positive ions increases faster than the emissivity of electrons. As a result, the signal-to-noise ratio of the thicker microchannel plate is severely decreased.

One proposed solution to this problem is presented in U.S. Pat. No. 3,742,224, issued Jun. 26, 1973 to Bernard C. Einstein. According to the '224 patent, a microchannel plate is understood to be provided with a substantially optically transparent but not self-supporting aluminum coating provided at the inlet end of the microchannels. This coating spans the inlet ends of the microchannels, and is asserted to trap positive ions.

Of interest is a paper entitled, "Preliminary Results with Saturable Microchannel Array Plates", by J. G. Timothy, published in Review of Scientific Instruments, Volume 45, No. 6, June 1974, pp. 834–837. This paper investigates the performance of microchannel plates having a lateral field caused by purely axial current flows in the secondary electron emitting semi-conductor surface of a microchannel plate provided with axially extending insulative strips separating this surface circumferentially into a plurality of elongate strips. The performance of such microchannel plates was not entirely satisfactory because of charge accumulation on the insulative strips. However, the author speculates that a different internal configuration for the microchannel plate might be tried with either a higher surface conductivity or a bulk-conductivity. How these speculative microchannel plates are to be realized is not taught by the author. There is no suggestion in this paper that the reduced secondary electron emitting surface portion can be omitted, or that a bulk-conductive glass will itself provide an adequate level of secondary electron emissions without reduction. Additionally, no appropriate bulk-conductivity glasses were then available in the microchannel plate, image intensifier, or photomultiplier arts.

SUMMARY OF THE INVENTION

In view of the deficiencies of the conventional related technology, it is a primary object for this invention to provide a microchannel plate avoiding one or more of these deficiencies.

Accordingly, it is an object of the present invention to provide an improved microchannel plate having channels surrounded by glass material which is a bulk conductor.

More particularly, it is an object for this invention to provide an improved microchannel plate having channels surrounded by glass material which is both a bulk conductor and an inherent emitter of secondary electrons, so that reduction of the glass to provide a semiconducting secondary electron emitting surface portion is not required.

It is also an object for this invention to provide an improved microchannel plate having channels surrounded by glass material which is both a bulk conductor and an inherent emitter of secondary electrons and also having inlet ends of these microchannels flared to provide both a concentration of the available electron-acceleration voltage field in the vicinity of the microchannel inlets and an improved secondary electron emissivity of the glass material in this area. The result is that not only is the OAR of the microchannel plate increased with improved electron collection efficiency and improved resolution combined with decreased signal-to-noise ratio; but also very importantly, the energy of electrons moving along the channels adjacent to the inlet ends of these channels is greater, at the same time that the secondary electron emissivity of the glass material is also increased so that the statistical probability of a cascade of secondary-emission electrons starting earlier and with more rapid progression is significantly improved.

An advantage of the microchannel plate as described immediately above is that the plate may be made thinner for the same performance level, thus decreasing the amount of glass used to fabricate the microchannel plate.

Still more particularly, it is an object for this invention to provide an improved microchannel plate having channels surrounded by glass material which is a bulk conductor and an inherent emitter of secondary electrons, but which includes a reduced surface portion of the glass to provide an improved more-conductive surface portion which is both a secondary electron emitting surface, and has a conductivity slightly greater than the bulk conductivity of the remainder of the glass surrounding the microchannels.

Another object for this invention to provide an improved microchannel plate having channels surrounded by glass material which is a bulk conductor and an inherent emitter of secondary electrons, but which includes an oxidized surface portion of the glass to provide an surface of reduced conductivity and reduced emissivity of secondary electrons.

It is yet another object of the present invention to provide a device which incorporates such an improved microchannel plate.

Particularly it is an object for this invention to provide an image intensifier tube having such an improved microchannel plate.

Another object for this invention is to provide a photomultiplier tube having such an improved microchannel plate.

Still another object for this invention is to provide a night vision device with an image intensifier tube having such an improved microchannel plate.

These and other objectives are achieved by a low ion feedback microchannel plate for receiving photoelectrons and responsively releasing secondary-emission electrons, said microchannel plate comprising: a plate-like substrate formed of selected glass material and defining a pair of opposite faces, said substrate defining a multitude of elongate parallel substantially straight microchannels extending between and opening at opposite ends on said pair of faces at a selected angle greater than zero relative to a perpendicular of said pair of faces, a pair of perforate conductive electrodes one on each of said pair of opposite faces, said selected glass material having a determined bulk resistivity such that an electrostatic voltage applied across said pair of electrodes provides an electric field extending substantially perpendicularly between said pair of electrodes and a corresponding current flow in said glass material, whereby said electric field provides to positive ions in said microchannels a lateral component of acceleration perpendicular to the axis of said microchannels.

A microchannel plate according to the present invention may include a metallic electrode coating which, at the inlet end of the microchannels, does not extend as far as perpendicular line of sight projection into these channels, thus leaving a greater exposed surface of secondary electron emitter at this inlet end of the microchannels. At the outlet ends of the microchannels, the metallic electrode extends conventionally into the electron-discharge ends of the microchannels. This extension of the metallic electrode material into the electron-discharge ends of the microchannels has some advantages so far as focusing the discharged electrons is concerned.

Other objects, features, and advantages of the present invention will be apparent to those skilled in the art from a consideration of the following detailed description of preferred exemplary embodiments thereof taken in conjunction with the associated figures which will first be described briefly.

BRIEF DESCRIPTION OF THE DRAWINGS

FIG. 3 is a schematic representation of a photomultiplier tube embodying the present invention;

FIGS. 4*a* and 4*b*, respectively, are a greatly enlarged fragmentary cross sectional elevation view, and a greatly enlarged cross sectional plan view, of a conventional prior-art microchannel plate;

FIG. 5 is a greatly enlarged cross-sectional elevation view of a microchannel plate according to one embodiment of the present invention;

FIG. 6 is a greatly enlarged cross-section elevation view of a microchannel plate according to another embodiment of the present invention;

FIG. 7 provides a graphical presentation of preferred bulk current flow versus bulk conductivity for microchannel plates embodying the present invention;

FIG. 8 is a fragmentary cross-sectional view of a step in the manufacture of a conventional microchannel plate;

FIG. 9 is a fragmentary cross-sectional view of a step in the manufacture of a microchannel plate according to the teachings of the present invention;

FIG. 11 provides a graphical representation of the voltage drop within a microchannel plate according to the invention versus distance from an electron-receiving face of this microchannel plate.

DETAILED DESCRIPTION OF THE INVENTION

While the present invention may be embodied in many different forms, disclosed herein are specific illustrative embodiments thereof that exemplify the principles of the invention. It should be emphasized that the present invention is not limited to the specific embodiments illustrated.

Figure 1:
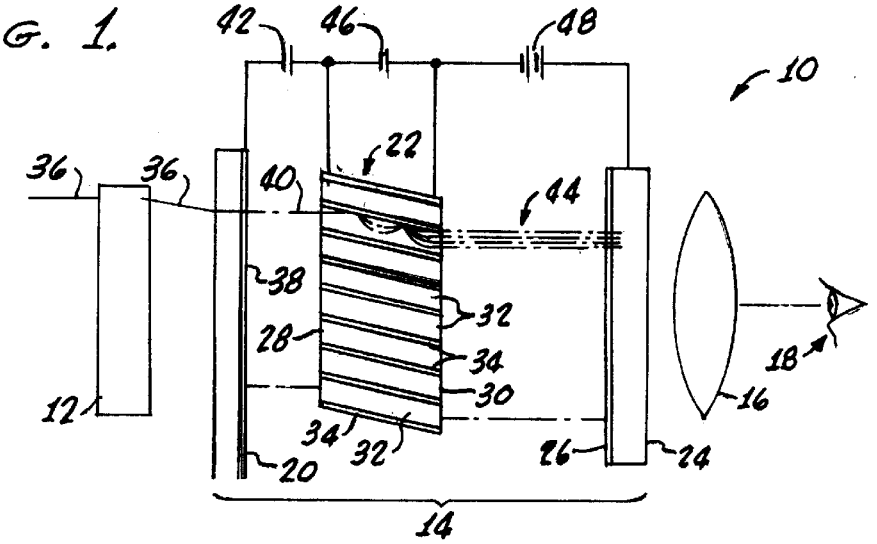
FIG. 1 is a schematic representation of a night vision device embodying the present invention, and having an image intensifier tube with an improved microchannel plate.

Referring first to FIG. 1, there is shown schematically the basic elements of one version of a night vision device 10. Night vision device 10 generally comprises a forward optical lens assembly 12 (illustrated schematically as a functional block element—which may include one or more lens elements) focusing incoming light from a distant scene on a front end of an image intensifier tube 14, and an eye piece lens illustrated schematically as a single lens 16 producing a virtual image of the rear end of the tube 14 at the user's eye 18. Image intensifier tube 14 comprises a photocathode 20, microchannel plate 22, and display electrode assembly 24 having an aluminized phosphor coating or phosphor screen 26. More particularly, microchannel plate 22 is located just behind photocathode 20, with microchannel plate 22 having an electron-receiving face 28 and an opposite electron-discharge face 30. Microchannel plate 22 further contains a plurality of angulated microchannels 32 which open on electron-receiving face 28 and electron-discharge face 30. Microchannels 32 are separated by passage walls 34. Display electrode assembly 24, generally having a coated phosphor screen 26, is located behind microchannel plate 22 with phosphor screen 26 in electron line-of-sight communication with electron-discharge face 30. Display electrode assembly 24 is typically formed of an aluminized phosphor screen 26 deposited on the vacuum-exposed surface of an optically transparent window material. Focusing lens 16 is located behind display electrode assembly 24 and allows an observer 18 to view a correctly oriented image corresponding to the initially received low level image.

As will be appreciated by those skilled in the art, the individual components of image intensifier tube 14 are all mounted and supported in a tube or chamber (to be further explained below) having forward and rear transparent plates cooperating to define a chamber which has been evacuated to a low pressure. This evacuation allows any electrons to be transferred between the various components without atmospheric interference that could possibly decrease the signal-to-noise ratio. However, as will be seen such evacuation of the chamber is never perfect, so that some gas molecules always remain to possibly become positive ions.

As indicated above, photocathode 20 is mounted immediately behind objective lens 12 and before microchannel plate 22. Typically, photocathode 20 is a circular disk having a predetermined construction and mounted in a well known manner. Suitable photocathode materials are generally semiconductors such as gallium arsenide; or alkali metals, such as compounds of sodium, potassium, cesium, and antimony (commercially available as S-20), on a readily available substrate. A variety of glass and fiber optic substrate materials are commercially available.

Responsive to photons 36 entering the forward end of night vision device 10 and passing through objective lens 12, photocathode 20 has an active surface 38 which emits electrons proportionately to the received optical energy. In general, the image received will be too dim to be viewed with human natural vision, and may be entirely or partially of infrared radiation which is invisible to the human eye. The shower of electrons emitted, hereinafter referred to as photoelectrons, are representative of the image entering the forward end of image intensifier tube 14. The shower of photoelectrons emitted from the photon input point on the photocathode 20 is represented in FIG. 1 by dashed line 40.

Photoelectrons 40 emitted from photocathode 20 gain energy through an electric field of predetermined intensity gradient established between electron-receiving face 28 and photo-cathode 20 by electric source 42. Typically, electric source 42 will be on the order of 200 to 800 volts to establish an electrostatic field of the desired intensity. Upon acceleration produced by passing through the electrostatic field, photoelectrons 40 enter microchannels 32 of microchannel plate 22. As will be discussed in greater detail below, the photoelectrons 40 are amplified to produce a proportionately larger number of electrons upon passage through microchannel plate 22. This amplified shower of secondary-emission electrons 44, accelerated by an electrostatic field generated by electrical source 46, then exits microchannels 32 of microchannel plate 22 at electron-discharge face 30, and is again accelerated in an established electrostatic field. This electrostatic field is established by electric source 48 between electron-discharge face 30 and display electrode assembly 24. Typically, electric source 48 produces a bias voltage on the order of 3,000 to 7,000 volts and more preferably on the order of 6,000 volts to impart the desired energy to the multiplied electrons 44.

The shower of secondary-emission electrons 44, now several orders of magnitude more intense than the initial shower of photoelectrons 40 but still in a pattern replicating the image focused on photocathode 20, falls on phosphor screen 26 of display electrode assembly 24 to produce an image in visible light. Those ordinarily skilled in the pertinent arts will recognize that the image produced may alternatively be one in infrared light, which is then directed to a charge coupled device particularly sensitive to light in the infrared portion of the spectrum. This alternative may be exercised by the simple selection of phosphors for the display screen 26 which emit in infrared light. It should be apparent that phosphor screen 26 acts as a means for converting the electron pattern generated by photocathode 20 to a visible or infrared light image of the initially received low level image. In the depicted embodiment, following conversion to a visible light image, the information (i.e., the image pattern) presented on phosphor screen 26 passes through focusing eye piece lens 16 to provide an observer 18 with the desired image.

Figure 2:
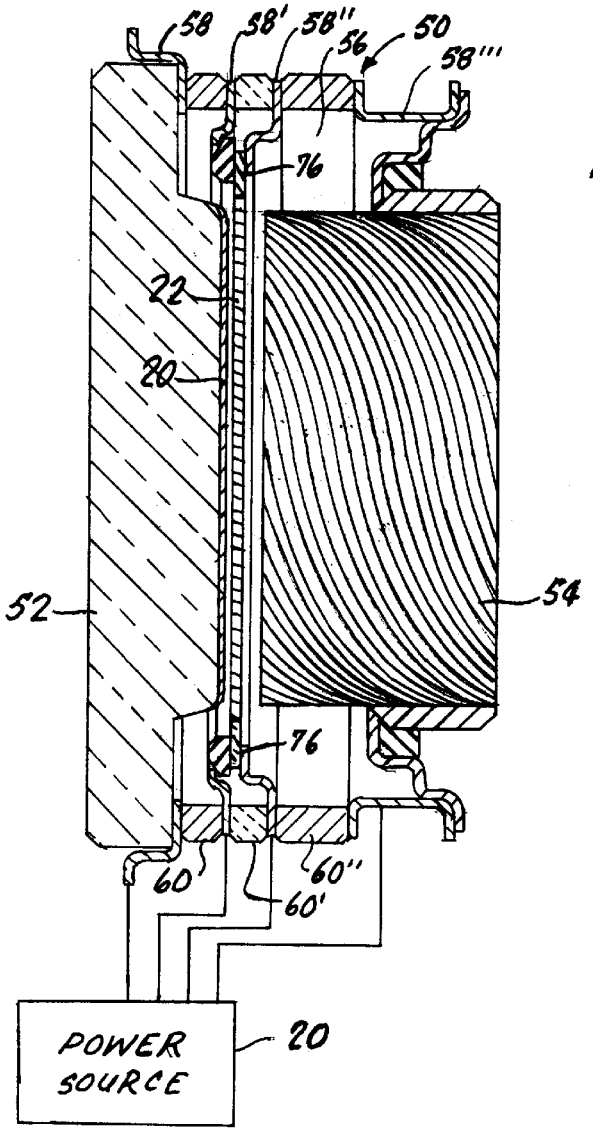
FIG. 2 shows an image intensifier tube according to the present invention with an improved microchannel plate.

Viewing FIG. 2 the image intensifier tube 14 is seen to include a tubular body 50, which is closed at opposite ends by a front light-receiving window 52, and by a rear fiber-optic image output window 54. As is illustrated in FIG. 2, the rear window 54 may be an image-inverting type in order to provide an erect image to the user 18, although this window is not necessarily of such inverting type. Both of the windows 52 and 54 are sealingly engaged with the body 50, so that an interior chamber 56 of the body 50 can be maintained at a vacuum relative to ambient. The tubular body 50 is made up of plural metal rings, each indicated with the general numeral 58 with a prime added thereto (i.e., 58, 58', 58", and 58''') as is necessary to distinguish the individual rings from one another. The tubular body sections 58 are spaced apart and are electrically insulated from one another by interposed insulator rings, each of which is indicated with the general numeral 60, again with a prime added thereto (i.e., 60, 60', and 60") as used above to distinguish the various insulator rings from one another. The sections 58 and insulators 60 are sealingly attached to one another. End sections 58 and 58''' are sealingly attached to the respective windows 52 and 54. Those ordinarily skilled in the pertinent arts will know that the body sections 58 are individually connected electrically to an electrostatic power supply 62, which includes sources 42, 46, and 48, and which is effective during operation of the image intensifier tube 14 to maintain an electrostatic field most negative at the section 58 and most positive at the section 58'''.

Further viewing FIG. 2, it is seen that the front window 52 carries on its rear surface within the chamber 56 the photocathode 20. Those ordinarily skilled in the pertinent arts will recognize that the light entering the front window 52 will be focused upon the photocathode 20 by lens 12 to produce an image of a distant scene. The photocathode 20 will respond to photons of this incident light by releasing a shower of photoelectrons in a pattern replicating the image.

Viewing now FIG. 3, an alternative embodiment of the present invention is depicted. This alternative embodiment of the invention takes the form of a photomultiplier tube using a microchannel plate. Because many of the features of the embodiment seen in FIG. 3 are the analogous to those depicted and described in connection with FIG. 2, the same reference numeral increased by 100 is used in connection with this second embodiment to indicate the same feature or features which are analogous in structure or function. The photomultiplier tube 114 includes a tubular body 150 closed at one of its two opposite ends by an input window 152. This input window carries a photocathode 120. Photoelectrons liberated from this photocathode in response to incident photons are received by a microchannel plate 122. At the other of its opposite ends, the body 150 is closed by an insulative multi-conductor electrical connector assembly 64. The inner surface 66 of the connector assembly 64 within the chamber 156 presents an array 68 of individual electrodes (anodes). Each of the individual anodes of array 68 is individually electrically connected through the connector assembly 64 to a respective individual connector pin in an array 70 of such connector pins presented outwardly on the body 150.

Because a certain level of electrons falls on each one of the individual anode of array 68, these individual anodes will have a respective imposed electrical charge in proportion to the optical photon input to the photocathode. The various resulting voltage or charge flows from the individual anodes of the array 68 is available externally of the photomultiplier tube 114 by electrical connection to the pins 70. These electrical voltage or charge flow levels at the pins 70 represent a mosaic of the image focused on the photocathode 120 in electrical form. Depending on the size of the individual anodes of the array 68, this mosaic may have only a blocky form with resolution sufficient only to reveal gross features of the image, or may with sufficiently small anodes in the array 68, present a fine mosaic with small-feature resolution. As explained above, this electrical analog image mosaic may be viewed by use of video equipment or may be processed with a computer for storage or viewing.

Hereinafter, a microchannel plate either by itself or in an image intensifier tube, a photomultiplier tube, or any other device, is referred to generally with the numeral 22, possibly with one or more primes added. That is, it will be understood that this reference to a microchannel plate includes also the microchannel plate 122 of a photomultiplier tube as was depicted in FIG. 3. Referring to FIG. 4, details of a conventional microchannel plate are shown. Photoelectrons falling on a conventional microchannel plate 22 will impinge on reduced-glass semiconductor inner surfaces (to be further explained) of the microchannels. Because these semiconductor surfaces are emitters of secondary electrons, the photoelectrons cause emission of proportionate numbers of secondary electrons. The secondary electrons will exit the microchannel plate 22 at the electron discharge face 30 in a shower pattern which replicates the image focused on the photocathode 20. On a front face of the fiber optic rear window 54 within the chamber 56 the phosphor screen 26 produces a visible image in phosphorescent light (e.g., yellow-green light for a type P-20 phosphor). This visible image is conducted through the fiber optic output window 54 and is presented on the rear surface of the image intensifier tube 14. Because of the discrete passage construction of the microchannel plate 22 as well as the discreet optical fiber construction of the fiber optic output window 54, the image available at the rear surface of the window 54 is a mosaic of the image focused on the photocathode 20.

Further considering FIGS. 4*a* and 4*b*, which depicts a conventional microchannel plate 22, it is seen that this conventional microchannel plate 22 includes an insulative glass substrate 72 composed of a great multiplicity of glass tubes 74 bonded to one another in parallel. Those ordinarily skilled in the pertinent arts will recognize that the microchannel plate 22 also includes a solid glass rim portion 76 (best seen in FIGS. 2 and 3). This rim portion 76 surrounds and supports the central active portion of the microchannel plate 22. The glass tubes 74 individually define the respective microchannel passages 32 extending from one face 28 to the other face 30 of the microchannel plate 22 at a slight angle from the perpendicular of these faces. In the drawing FIGS. 4*a*, 5, 6, 8, 9, and 10 the angulation of the microchannels 32 (i.e., 32, 32', and 32") is exaggerated for clarity of illustration. At the face 28 a metallic electrode 78 is applied to the substrate 72, and contacts also the semiconducting, secondary-electron emitting layer 84.

Viewing FIG. 8, it is seen that this metallic electrode 78 is conventionally applied to the face 28 using conventional techniques (e.g., electron beam deposition, or vapor deposition), with a metallic source 80 from which metal is evaporated onto the face 28. Ordinarily, this process is carried out with the work pieces for microchannel plates laying on a turntable resulting in an effective relative orbital motion of the source 80 in a plane skewed with respect to the face 28 and perpendicular to a line paralleling the axis of the microchannels 32. This process is conventional, and so is not explained further than the illustration of FIG. 8. However, it is seen from FIGS. 4*a* and 8 that the coating for electrode 78 extends into the microchannels 32 a distance about equal to one channel diameter completely around the circumference of the microchannels 32. Similarly, at the electron-discharge face 30, the microchannel plate 22 carries another metallic electrode 82, which extends into the channels 32 about one to two channel diameters. This extension of the electrode 82 into the exit end of the microchannels 32 has conventional advantages for electrostatic lensing of the electrons exiting these channels. The electrode 82 is applied using the same or similar conventional techniques as those used to apply electrode 78. The electrodes 78 and 82 do not span or close the channels 32.

In the conventional microchannel plate seen in FIGS. 4*a* and 4*b*, between the faces 28 and 30 the microchannels 32 are lined with a semiconducting, secondary-electron-emitting surface portion 84 of the substrate 72, which surface portion is produced by reduction of the glass of substrate 72 at elevated temperature in a hydrogen atmosphere. Because an electrostatic voltage differential is maintained between the electrodes 78 and 82 during operation of the microchannel plate 22, these electrodes 78 and 82 contact the surface portions 84, and the material of substrate 72 at surface portions 84 is a semiconductor, a current flows in the surface portions 84 as is indicated by arrow 86. It will be noted that the arrows 86 are conventionally directed from positive to negative, but those skilled in the pertinent arts will recognize that electron flow is in the opposite direction. Also, as a reminder to the reader of the sense of the voltage applied to the microchannel plates, a parenthetical plus (+), or minus (–) sign has been added to the drawing Figures where appropriate. This current 86 is conventionally referred to as the "strip current" of the microchannel plate 22. Because the flow direction of current 86 is parallel with the axis of the channels 32, the electric field for this current also parallels the axis of the channels 32. Regardless of the angulation of the channels 32, there is in the conventional microchannel plate as depicted, no effective lateral component of the electric field from current 86 over most of the length of the channels 32. Further, the electric field driving the strip current 86 is substantially uniform along the length of the microchannels 32. In other words, the semiconductor surface portion 84 have a substantially uniform resistance per unit length over the entire length of the microchannels 32. Also, the secondary electron emissivity of the surface portion 84 is about the same along the length of the microchannels 32, assuming that the current flow is sufficient to avoid electron depletion of this material 84.

In the conventional microchannel plate, upon photoelectrons reaching electron-receiving face 28, a typical electron (indicated with arrow 88) enters a microchannel 32. Because the electrode 78 extends into the channel 32 quite a distance (i.e., about one channel diameter), if the electron 88 first impinges on this metallic surface of the electrode 78 there is a significant probability that the electron will be absorbed, or if not absorbed will not result in the emission of one secondary electron (i.e., the electrode 78 would be expected to have an emissivity of about unity (1). The presence of electrode 78 into the entrance end of the channels 32 is thus seen to present a disadvantage to the electron multiplication capability of the conventional microchannel plate 22 because the cascade of photoelectrons and secondary-emission electrons along these channels does not start as soon as it might.

On the other hand, if the electron first impinges on a part of the surface portion 84, the electron will likely result in one or more secondary-emission electrons being emitted. The surface 84 conventionally has a secondary electron emissivity coefficient of as much as about 2.0 to about 2.5. As these secondary-emission electrons continue along the channel 32, successive impacts of the secondary-emission electrons with the wall portion 84 and additional emissions of secondary-emission electrons results in a shower of secondary-emission electrons exiting the microchannel plate 22 at the face 30. With conventional microchannel plates, each photoelectron which enters a channel 32 at face 28 can result in about $10^3$ to $10^5$ electrons exiting the channel 32 at face 30. Some conventional high-output microchannel plates will achieve an electron gain $10^6$, but require very careful design and control of their operation to avoid thermal runaway. The multiplied electrons then exit from the openings at face 30 of microchannel plate 22 and are accelerated to strike phosphor screen 26 thereby producing a conventional image in visible light as described above.

Considering now FIG. 5, a microchannel plate 22' according to the present invention is depicted. In order to obtain reference numerals for us in describing this microchannel plate, features which are analogous to those described above are referenced with the same numeral used above, and having a prime (') added thereto. This microchannel plate 22' includes a semi-conductive (and semi-insulative) glass substrate 72'. That is, in contrast to the substantially insulative glass substrate of the conventional microchannel plate, the glass substrate 72' has a bulk conductivity, as will be further explained. In this case also, the substrate 72' includes a great multiplicity of glass tubes 42' bonded to one another in parallel. These glass tubes 42' individually define respective microchannel passages 32' extending at a slight angle from the perpendicular from one face 28' to the other face 30' of the microchannel plate 22'.

Also, at the face 28' a metallic electrode 78' is applied. This metal electrode 78' extends across the face 28', but does not extend very far into the passages 32' on the circumferential side of these passages which is visible in perpendicular line-of-sight view into these passages. Viewing FIG. 9, it is seen that during the manufacturing process for the electrode coating 78', the work piece for the microchannel plate 22' is also rotationally disposed on a turntable relative to the evaporation source, as is the case with conventional microchannel plates. However, unlike the prior-art microchannel plate previously discussed, electrode 78' is not deposited from an evaporation source apparently orbiting perpendicularly to the central axis of the microchannels 32'. Instead, the evaporation source 80' and work piece for microchannel plate 22' are positioned and relatively rotated so that the source 80' appears to orbit about the central axis of the microchannels with a circumferentially variable angulation. That is, the microchannel plate work piece is tipped relative to the axis of rotation in the direction of and in the plane of the angulation of the microchannels relative to the surface 28', and is rotated relative to the source 80' so as to provide for the circumferentially varied angulation of deposition of conductive material for the electrode 78'.

The effect of this angulation of the work piece for microchannel plate 22' relative to the axis of rotation is to make the source 80' appear to orbit the microchannels with an angulation relative to the axis of the channels which varies circumferentially. The greatest angulation of the source 80' relative to the axis of the microchannels 32' is achieved on the side where the microchannels are angulated acutely relative to the surface 28'. On the other hand, the least angulation of the source 80' relative to the microchannels 32' is achieved on the side where the microchannels are angulated obtusely relative to the surface 28', viewing FIG. 9. As can be seen by the crossed projection arrows from source 80' into the microchannels 32', the material from the source can penetrate more deeply on the "shaded" side of the microchannels (with respect to a perpendicular line of sight view into the microchannels 32'), and penetrates only a shallow distance (if at all) on the other side of the microchannels 32' at the entrance portion thereof.

That is, rather than being applied with a fixed angulation and with a substantially uniform depth into the microchannels 32', conductive material from source 80' for electrode 78' is applied to microchannel plate 22' at a circumferentially variable angle based on the angulation of the microchannels themselves relative to the surface 28'. Thus, a perpendicular line-of-sight view into the microchannels 32' shows only a little electrode material 78' extending into the channels, and a comparatively large area of the surface portion 84' exposed to electron impacts. By using this circumferentially varying angulated deposition of the electrode material, the necessary electrical conductivity may be established on the microchannel plate face 28' without reducing the amplification potential of microchannels 32'. Thus, electron amplification by microchannels 32' begins immediately upon impact of photoelectron 88' rather than being delayed until the second or third strike as seen in prior art microchannel plates. This immediate amplification essentially increases the usable microchannel length and gain of the plate without requiring an increase in the applied electrostatic field, and without physically expanding the thickness of the plate so that the noise created by the plate would be increased. Because the gain and signal output of the inventive microchannel plate is increased considerably without an increase in noise production, the signal-to-noise ratio of the inventive microchannel plate is considerably improved as well.

Further considering FIG. 5, it is seen that between the electrodes 78' and 82', the microchannels 32' expose the surface 84' of the bulk-conductivity glass used to form the substrate 72'. That is, in this case, the surface 84' is not coated with or converted by reduction into a semiconducting reduced surface. In this instance, no reduction of this surface 84' at elevated temperature in a hydrogen atmosphere is required. The bulk-conductivity glass of the substrate 72 is inherently an emitter of secondary-emission electrons. In general, the Applicants have found the secondary electron emissivity of the bulk-conductivity glass materials herein referred to be in the range from about 2.3 to 2.5.

With the microchannel plate 22', because an electrostatic voltage differential is maintained between the electrodes 78' and 82' during operation of the microchannel plate, and the bulk-conductivity glass of substrate 72' is a semiconductor, a current flows in material of substrate 72' itself. That is, this current flow is not confined to a surface portion of the passages 32' as in conventional microchannel plates, and is not properly a "strip current". The current in the substrate 72' is indicated on FIG. 5 with the arrow 86'. It will be noted that the direction of arrow 86' is perpendicular to the faces 28' and 30' along the path of shortest distance between the electrodes 78' and 82', and is angulated relative to the passages 32'. The current flow 86' is referred to herein as a "bulk current", and the total current flow of the microchannel plate 22' is expected to be in the same range as for the conventional microchannel plate 22.

As with the conventional microchannel plate 22, upon photoelectrons reaching electron-receiving face 28' of the microchannel plate 22', a typical electron (indicated with arrow 88') enters a microchannel 32'. However, because in this case the electrode 78' extends into the microchannels 32' only a short distance on the portion of these channels which is visible in perpendicular line-of-sight view into the channels 32', the electron 88' will most likely first impinge on the secondary electron emitting surface 84' of the glass substrate 72' itself. Because the glass substrate 72' has a secondary electron emissivity in a usable range for a microchannel plate (i.e., greater than 1.0), this electron impact will likely result in one or more secondary-emission electrons being emitted.

As the secondary electrons 88' continue along the channel 32', successive impacts of the secondary-emission electrons with the wall surface 84' and additional emission of secondary-emission electrons results in a shower of secondary-emission electrons exiting the microchannel plate 22' at the face 30'. Each photoelectron which enters a channel 32' at face 28' can result in up to $10^6$ or more electrons exiting the channel 32' at face 30'. However, with the microchannel plate 22', the higher levels of electron production are easier to obtain without resorting to high bulk currents (i.e., strip currents) as are required with conventional high-output microchannel plates.

Further to the above, when a positive ion 90 enters or is created within one of the channels 32', this ion is subject to a lateral field and lateral acceleration, indicated with arrow 92 because the electrostatic field and current flow 86' have a component perpendicular to the axis of the channels 32' (i.e., a lateral component). This lateral acceleration 92 moves the positive ions against the wall surface 84', and results in an electron being combined with the positive ion 90, producing a neutral particle or gas atom. Such neutral particles do not accelerate in the electrostatic field within a microchannel, and therefore, do not produce ion-induced emission of electrons, which electrons would act as a source of noise in an image intensifier tube or photomultiplier tube, and these ions also do not bombard the photocathode of such tubes. Also, for the same reasons, neutral particles do not have sufficient energy to induce unwanted electron emissions from the photocathode. As a result, the photocathode of a device using a microchannel plate according to the present invention may be made more sensitive to photons because it does not have to be made as resistant to ion bombardment.

Considering now FIG. 6, an alternative embodiment of a microchannel plate according to the present invention is depicted. In order to obtain reference numerals for us in describing this microchannel plate, features which are analogous to those described above are referenced with the same numeral used above, and having a double prime (") added thereto. The microchannel plate 22" includes a semi-conductive and semi-insulative glass substrate 72", which is formed of a bulk-conductivity glass. The substrate 72" includes a great multiplicity of glass tubes 42" bonded to one another in parallel. The glass tubes 42" individually define respective passages 32" extending at a slight angle from the perpendicular from one face 28" to the other face 30" of the microchannel plate 22". Also, at the face 28", a metallic electrode 78" is applied. This metal electrode extends across the face 28", but does not extend very far into the passages 32". That is, in this case also the electrode 78 extends into the passages 32" most deeply on the shaded side and not very far on the side visible in perpendicular line-of-sight view, as explained with reference to FIG. 9.

At the electron-discharge face 30", the microchannel plate 22" carries a metallic electrode 82", which in this case also extends into the channels 32" about one to two channel diameters. Between the electrodes 78" and 82", the microchannels 32" expose the surface of the bulk-conductivity glass used to form the substrate 72". However, in this case, the surface of the microchannels 32" are coated with an additionally conductive and additionally more emissive, secondary-electron-emitting surface portion 84" of the substrate 72". This surface portion 84" is produced by reduction of the glass of substrate 72" at elevated temperature in a hydrogen atmosphere similarly to that which is done with a conventional microchannel plate. However, in marked contrast to the conventional microchannel plate, this reduction of the glass at surface portion 84 does not produce a conductor, it merely makes a semiconductor more conductive, and more emissive of secondary electrons. Additionally, the degree of reduction of surface portion 84", and the length of the manufacturing process necessary to effect this reduction, is less for the microchannel plate 22" than with conventional MCP's. Although the increased conductivity of the surface portion 84" results in a strip current at that surface which is higher per unit area than the bulk current in the material of substrate 72", the bulk current flow distortion is not sufficient to shift the electrostatic field entirely parallel to the passages 32, as happens in conventional microchannel plates. Accordingly, the microchannel plate 22" still maintains a lateral component of the field (i.e., arrow 92'), and positive ions are recombined within the plate 22" rather than being shot toward the photocathode of any device using this microchannel plate.

Preferably, the bulk resistivity (i.e., the inverse of bulk conductivity) of the microchannel plates 22' and 22" is represented by the equation $\rho=22(1-OAR)/ID$, (equation 1) in which $\rho$ is the bulk resistivity in ohm-cm, OAR is the open area ratio of the microchannel plate, I is the equivalent strip current requirement in amperes per $cm^2$, and D is the diameter of channels 32 in cm. The value "22 volts" is an optimized or preferred value for voltage applied per L/D ratio of the channels 32 (where L is length and D is diameter) to achieve uniform channel-to-channel electron amplification. This value is subject to some variation dependent on the operating environment of the particular microchannel plate. FIG. 7 provides a graphical depiction of the preferred bulk resistivity "$\rho$" of the glass material for substrate 72' and 72" as a function of the equivalent strip current (expressed as "bulk current" $J_B$, in FIG. 7) in the microchannel plate. As can be seen viewing FIG. 7, the preferred range for this bulk resistivity spans three orders of magnitude, dependent on the desired equivalent bulk current "$J_B$". That is, the preferred resistivity for the glass from which the tubes 42', 42" is fabricated, and which cooperatively forms the substrate 72', 72", extends from the $10^6$ ohm-cm range into the $10^8$ ohm-cm range. Thus, this resistivity is seen to span three orders of magnitude. Further, the Applicants believe that glasses having bulk resistivity both somewhat below and considerably above these preferred values will function satisfactorily in microchannel plates according to the present invention. Analysis of the operating requirement for the present microchannel plates indicates that a bulk resistivity as high as the $10^{11}$ ohm-cm range will allow the microchannel plates to operate satisfactorily.

In the course of conceiving and actually reducing the present invention to practice, an actual microchannel plate according to the embodiment of FIG. 5 has been analyzed and found to operate according to the principles herein presented. Newly available conductive glasses, such as the BC-series glasses from American Cystoscope Manufacturing Inc. ("ACMI"), of Stanford, Conn., and the W-11 glass from Hoya Company; of 3-3-1 Nusashino, Akishima; Tokyo; Japan 196, may be used to practice this invention. The applicants believe that the predecessors of these bulk-conductivity glasses were developed for use in another field of art. Particularly, it is believed that the predecessors of these glasses were originally developed for use in lasers, and that their application by the applicants to microchannel plates, image intensifier tubes, photomultiplier tubes, and night vision devices of all descriptions is a new and unanticipated use for an existing composition of matter. That is, these bulk-conductivity glasses were not developed for, nor have they been previously applied to the present use. It will further be understood that the invention is not limited to the above-identified bulk-conductivity glasses, and that other such bulk-conductivity glasses as may in the future become available may be used to practice the invention. Indeed, now that the applicants have pointed the way by identifying and applying a category of glasses which are useful in the practice of the present invention, it is to be expected that in the future other particular formulations for bulk conductivity glasses will be found to be useful for practice of the present invention.

As an example of a microchannel plate embodying the present invention, if a microchannel plate were to have an OAR of 63%, an I of $1\times10^{-6}$, and a D of $8\times10^{-4}$, then equation 1 above indicates a preferred bulk resistivity for the material of substrate 72 of $1.0\times10^{10}$. Bulk-conductivity glasses will allow microchannel plates with L/D ratios of 80:1 to be easily fabricated.

Figure 10:
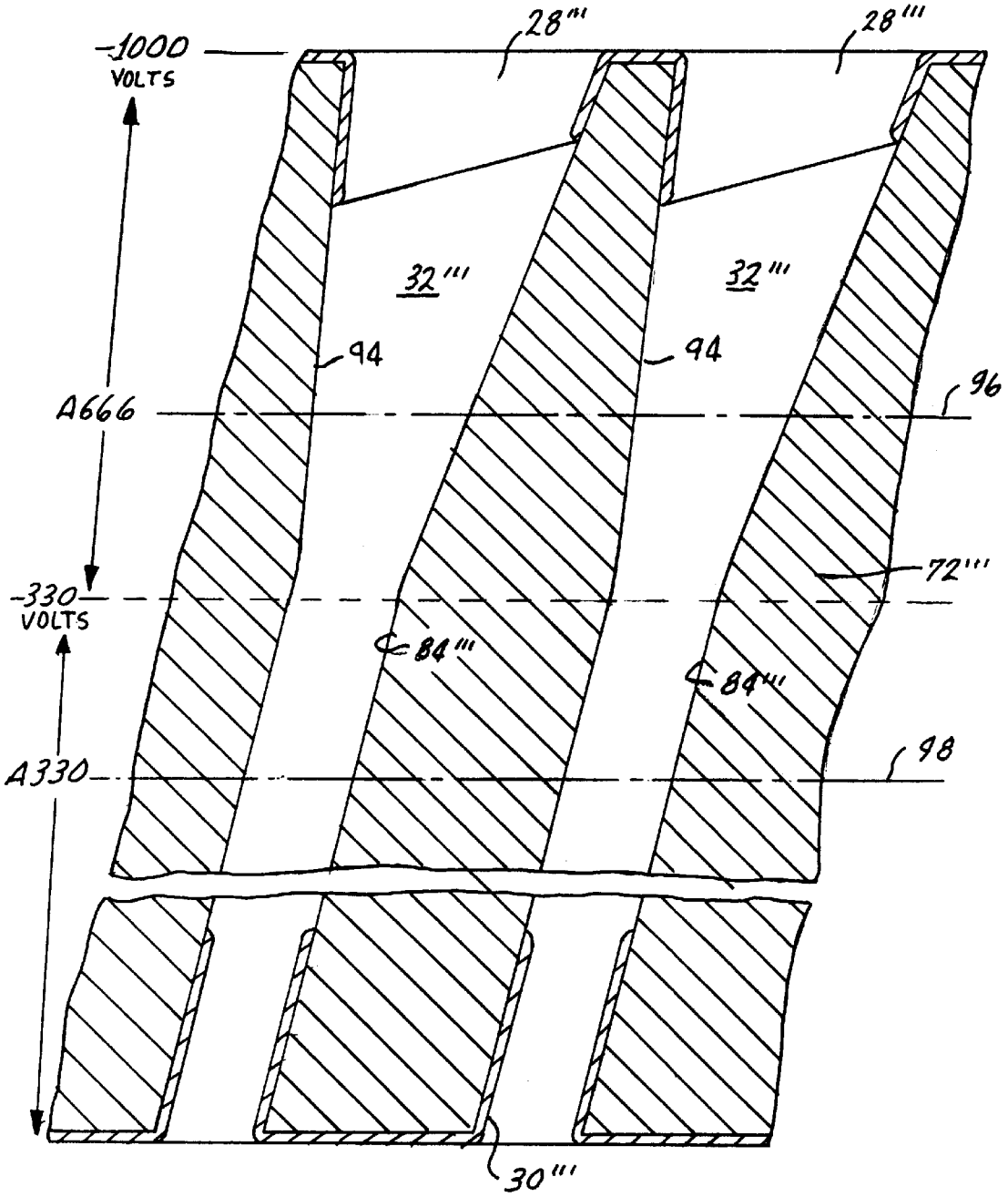
FIG. 10 provides a greatly enlarged fragmentary cross sectional elevation view of a microchannel plate according to the teachings of the present invention.

Considering now FIG. 10, an additional and advantageous aspect of the present invention is depicted. Viewing FIG. 10, it is seen that a microchannel plate 22''' includes a substrate 72''' of semi-conductive, bulk-resistivity glass. The passages 32''' are flared outwardly to a larger diameter at their opening on face 28''' than the diameter of these passages over the remainder of their length. For purposes of illustration, a flare portion 94 of the passages 32''' is illustrated as being about ½ of the total length of these passages between the faces 28''' and 30'''. It will be understood that the flare portion 94 of the passages 32''' may be greater or less than the illustrated ½ of the length of these passages. Also, those ordinarily skilled in the pertinent arts will understand that the microchannels 32''' may flare only at their inlet ends, at both their inlet and outlet ends, or only at their outlet ends.

Now it is easily understood that because the passages 32''' flare to an increased diameter at face 28''', there is less cross sectional area of substrate 72''' available to conduct current at a plane 96, for example, in the portion 94 than there is at plane 98 in the cylindrical portion of the passages 32'''. As a result of this decreased cross sectional area in the portion 94, the voltage drop per unit depth into the plate 22''' from electrode 78''' toward electrode 80''' is greatest at the surface 28 and decreases through out the portion 28 (i.e., has a non-uniform gradient) to reach a constant value in the cylindrical portion of the passages 32'''.

Along the left-hand side of FIG. 10 is depicted a consequence of this non-uniform gradient voltage drop in the plate 22'''. If for example, the voltage differential across plate 22''' is 1000 volts, then about two-thirds of this voltage drop (i.e., about 666 volts), for example, may be realized in the first one-half of the thickness of plate 32''' from surface 28''' proceeding into the plate in the direction of electron movement The consequence is that the electron emissivity of the material of substrate 72''' is enhanced in the portion 94. Further, when photoelectrons and secondary-emission electrons move along the channels 32''' in the portion 94, they are accelerated by the electric field, which is a function of the voltage drop per unit depth of the plate 22'''. Because the plate 22''' illustrated in FIG. 10 has a high and non-uniform voltage drop gradient in the portion 94, the electrons in channels 32''' are accelerated most strongly in this portion of the plate. As a consequence, the electrons accelerating along channels 32''' in the flare portion 94 gain velocity more quickly and are more energetic when they next impact the walls of the channels 32'''.

FIG. 11 provides a graphical illustration of voltage drop in the microchannel plate 22''' versus depth into the microchannel plate from the electron-receiving surface 28. As can be seen from the voltage line 100, a conventional microchannel plate will have a uniform voltage drop along the channels of this conventional plate, and the electron emissivity will similarly be uniform, and will not be higher at the entrance portions, provided that there is enough current flow to avoid electron depletion of the semiconductor material 84 in the portions of the channels adjacent to the electron-discharge face of the plate. In contrast the line 102 of the graph presented in FIG. 11 depicts a possible voltage drop curve in an inventive microchannel plate using bulk-conductivity glass with flared portion 94. An electron accelerating along a microchannel passage 32''' proceeding from the electron receiving surface 28''' and passing through the input conical section of channel 94 experiences maximum acceleration near the large end of the conical section 94, and lower acceleration at the junction of this conical section with the cylindrical sections of these passages. Because an impact by an energetic electron is more likely to result in the emission of secondary electrons, the microchannel plate 22''' of FIG. 10 has a greater electron cascade growth early in the length along channels 32'''. As a result, this microchannel plate has a greater gain for a particular thickness than a microchannel plate with straight channels and the same current flow.

Of course those skilled in the art will appreciate that the various embodiments of the present invention enumerated above are not mutually exclusive and may be used in any combination to provide microchannel plates having the desired characteristics. Those skilled in the art will further appreciate that the present invention may be embodied in other specific forms without departing from the spirit or central attributes thereof. Because the foregoing description of the present invention discloses only exemplary embodiments thereof, it is to be understood that other variations are recognized as being within the scope of the present invention. Accordingly, the present invention is not limited to the particular embodiments which have been described in detail herein. Rather, reference should be made to the appended claims to define the scope and content of the present invention.

We claim:

1. A microchannel plate for receiving photoelectrons and responsively releasing secondary-emission electrons, said microchannel plate comprising:

a plate-like substrate defining a pair of opposite faces and formed from substantially un-reduced selected glass material which is free of a reduced semiconductor glass portion and is an inherent emitter of secondary electrons.

2. A microchannel plate according to claim 1 wherein said selected glass material has a resistivity in the range from $10^6$ ohm-cm to $10^{11}$ ohm-cm.

3. A microchannel plate according to claim 1 wherein said selected glass material has a resistivity in the range from $10^8$ ohm-cm to $10^{10}$ ohm-cm.

4. A microchannel plate according to claim 1 further including a multitude of elongate parallel substantially straight microchannels having an inner surface extending between a pair of perforate conductive electrodes, and said inner surface is defined by reduced selected glass material which has a resistivity lower than that of said selected glass material and has an emissivity of secondary electrons greater than an inherent secondary electron emissivity of said selected glass material.

5. A microchannel plate according to claim 1 wherein the microchannel plate includes an electron-receiving face, and further includes means for effecting a local increase in the inherent emissivity of secondary electrons of said selected glass material adjacent to said electron-receiving face.

* * * * *